US009090424B1

(12) United States Patent
Armbruster et al.

(10) Patent No.: US 9,090,424 B1
(45) Date of Patent: Jul. 28, 2015

(54) DRIVE ROLLER CONFIGURATION PROVIDING REDUCED WEB WRINKLING

(71) Applicants: Randy Eugene Armbruster, Rochester, NY (US); Christopher M. Muir, Rochester, NY (US); Bradley Stephen Bush, Hilton, NY (US); W. Charles Kasiske, Jr., Webster, NY (US)

(72) Inventors: Randy Eugene Armbruster, Rochester, NY (US); Christopher M. Muir, Rochester, NY (US); Bradley Stephen Bush, Hilton, NY (US); W. Charles Kasiske, Jr., Webster, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/243,153

(22) Filed: Apr. 2, 2014

(51) Int. Cl.
*B41J 2/01* (2006.01)
*B65H 23/025* (2006.01)
*B41J 11/00* (2006.01)

(52) U.S. Cl.
CPC ..... *B65H 23/025* (2013.01); *B41J 11/00* (2013.01)

(58) Field of Classification Search
CPC ..... B65H 23/05; B41J 11/00
See application file for complete search history.

(56) References Cited

U.S. PATENT DOCUMENTS

| | | | | | |
|---|---|---|---|---|---|
| 3,884,623 | A * | 5/1975 | Slack | 432/60 |
| 5,605,777 | A * | 2/1997 | Ando et al. | 430/124.15 |
| 5,655,201 | A * | 8/1997 | Islam et al. | 399/322 |
| 5,689,789 | A * | 11/1997 | Moser | 399/331 |
| 5,737,679 | A * | 4/1998 | Uehara et al. | 399/329 |
| 5,820,122 | A * | 10/1998 | Schneider | 271/188 |
| 5,961,234 | A * | 10/1999 | Uchikata | 400/636 |
| 6,665,512 | B1 * | 12/2003 | Yanagida et al. | 399/313 |
| 8,303,106 | B2 | 11/2012 | Kasiske, Jr. et al. | |
| 8,303,107 | B2 | 11/2012 | Kasiske, Jr. et al. | |
| 2009/0184463 | A1 * | 7/2009 | Shakespeare et al. | 271/265.01 |
| 2010/0054826 | A1 | 3/2010 | Hieda | |
| 2010/0178089 | A1 * | 7/2010 | Fukuhata | 399/333 |
| 2012/0223117 | A1 | 9/2012 | Kasiske, Jr. et al. | |
| 2012/0223118 | A1 | 9/2012 | Piatt et al. | |
| 2012/0237275 | A1 * | 9/2012 | Fromm | 399/329 |

FOREIGN PATENT DOCUMENTS

| | | | |
|---|---|---|---|
| JP | 5-310336 | * 11/1993 | B65H 3/52 |

* cited by examiner

*Primary Examiner* — Julian Huffman
(74) *Attorney, Agent, or Firm* — Kevin E. Spaulding

(57) ABSTRACT

A web-guiding system for guiding a web of media along a transport path comprising a drive roller rotated by a motor and a plurality of nip rollers. The drive roller includes a first section, a second section and a third section along the length of the roller, the second section being located between the first section and the third section. A diameter of a surface envelope around the exterior surface of the drive roller is substantially constant within the second section, and is larger in the first section and the third section than in the second section. The nip rollers are aligned with the second section of the drive roller, with the web of media passing between the drive roller and the nip rollers.

14 Claims, 14 Drawing Sheets

DRIVE ROLLER CONFIGURATION PROVIDING REDUCED WEB WRINKLING

CROSS REFERENCE TO RELATED APPLICATIONS

Reference is made to commonly assigned, co-pending U.S. patent application Ser. No. 14/016,427, entitled "Positive pressure web wrinkle reduction system," by Kasiske Jr., et al.; to commonly assigned, co-pending U.S. patent application Ser. No. 14/016,440, entitled "Negative pressure web wrinkle reduction system" by Kasiske et al.; to commonly assigned, co-pending U.S. patent application Ser. No. 14/190,125, entitled "Media-guiding system using Bernoulli force roller" by Muir et al.; and to commonly-assigned, co-pending U.S. patent application Ser. No. 14/222,699, entitled "Web-guiding structure with continuous smooth recesses" by Muir et al., each of which is incorporated herein by reference.

FIELD OF THE INVENTION

This invention pertains to the field of media transport, and more particularly to an apparatus for guiding a web of receiver media using a drive roller configuration having a pattern of alternating ridges and recesses to reduce wrinkle artifacts caused by media expansion.

BACKGROUND OF THE INVENTION

In a digitally controlled inkjet printing system, a receiver media (also referred to as a print medium) is conveyed past a series of components. The receiver media can be a cut sheet of receiver media or a continuous web of receiver media. A web or cut sheet transport system physically moves the receiver media through the printing system. As the receiver media moves through the printing system, liquid (e.g., ink) is applied to the receiver media by one or more printheads through a process commonly referred to as jetting of the liquid. The jetting of liquid onto the receiver media introduces significant moisture content to the receiver media, particularly when the system is used to print multiple colors on a receiver media. Due to the added moisture content, an absorbent receiver media expands and contracts in a non-isotropic manner, often with significant hysteresis. The continual change of dimensional characteristics of the receiver media can adversely affect image quality. Although drying is used to remove moisture from the receiver media, drying can also cause changes in the dimensional characteristics of the receiver media that can also adversely affect image quality.

FIG. 1 illustrates a type of distortion of a receiver media 3 that can occur during an inkjet printing process. As the receiver media 3 absorbs the water-based inks applied to it, the receiver media 3 tends to expand. The receiver media 3 is advanced through the system in an in-track direction 4. The perpendicular direction, within the plane of the un-deformed receiver media, is commonly referred to as the cross-track direction 7. Typically, as the receiver media 3 expands (or contracts) in the cross-track direction 7, contact between the receiver media 3 and contact surface 8 of rollers 2 (or other web guiding components) in the inkjet printing system can produce sufficient friction such that the receiver media 3 is not free to slide in the cross-track direction 7. This can result in localized buckling of the receiver media 3 away from the rollers 2 to create lengthwise flutes 5 (also called ripples or wrinkles) in the receiver media 3. Wrinkling of the receiver media 3 during the printing process can lead to permanent creases in the receiver media 3 which adversely affects image quality.

Commonly-assigned U.S. Pat. No. 8,303,106 to Kasiske et al., entitled "Printing system including web media moving apparatus" and U.S. Pat. No. 8,303,107 to Kasiske et al., entitled "Printing method including web media moving apparatus," both of which are incorporated herein by reference, disclose a) a printing system having a printhead that moistens at least a portion of a web of print media, and b) a roller including a pattern of recesses and ridges, so that the web contacts a portion of the roller downstream of the printhead. The recesses and ridges help compensate for cross track expansion of the print media caused by absorption of water-based ink and also help reduce the likelihood of wrinkling of the print media. Also disclosed as shown in FIG. 2 (a copy of FIG. 9 in the aforementioned U.S. Pat. No. 8,303,106) is a drive roller 100 having an alternating pattern of ridges 106 and recesses that are positioned along the axis of rotation 102. Drive roller 100 is divided into a first section 108, a second section 110, and a third section 112, where the second section 110 is located between the outer first and third sections 108, 112. Drive roller 100 includes a concave profile, such that the diameter of the ridges 106 located in the first section 108 and the third section 112 of the drive roller 100 are greater than the diameter of the ridges 106 located in the central second section 110 of the roller 100. Drive roller 100 is driven, for example, by motor 152. A first nip roller 154 is positioned to engage a first ridge 156 of the ridges 106 of drive roller 100 and a second nip roller 158 is positioned to engage a second ridge 160 of the ridges 106 of drive roller 100. The first ridge 156 is located proximate to a first edge 162 of print media, and the second ridge 160 is located proximate to a second edge 164 of the receiver media 3 (FIG. 1).

U.S. Patent Application Publication 2010/0054826 to Hieda, entitled "Web transfer method and apparatus," discloses a web control system that includes a tiered roller and a pair of nip rollers. The tiered roller is formed to have a larger diameter at both ends than in a central portion. The nip rollers are arranged to incline outward to spread the web as it passes between the tiered roller and the nip rollers.

Recently it has been found that wrinkling can occur for lighter weight papers (densities on the order of 100 grams per square meter or less) if the nip rollers for a drive roller are located near the edges of the web. In addition, during start up of the printing system, the web can shift back and forth along the cross-track direction. If the nip rollers are located near the edges of the web of print media, they can move off the edges and cause web breaks. Furthermore, drive rollers having the nip rollers positioned at the ends of the roller as in FIG. 2 cannot accommodate a wide range of web widths. For narrower media, one or both nip rollers will not be in contact with the web.

What is needed is a drive roller configuration having a profile that compensates for dimensional changes in the web to reduce wrinkling in the web, while also providing reliable engagement of the nip rollers with a wide range of receiver media widths, even during start up of the system

SUMMARY OF THE INVENTION

The present invention represents a web-guiding system for guiding a web of media having a width spanning a cross-track direction travelling from upstream to downstream along a transport path in an in-track direction, the web of media having a first side and an opposing second side, comprising:

a drive roller including an exterior surface, wherein the first side of the web of media contacts at least a portion of the exterior surface of the drive roller, the drive roller having a length and including a first section, a second section and a third section along the length of the roller, the second section being located between the first section and the third section, wherein a diameter of a surface envelope around the exterior surface of the drive roller is substantially constant within the second section and wherein the diameter of the surface envelope in the first section and the third section is larger than the diameter of the surface envelope in the second section;

a motor that rotates the drive roller, thereby providing a force to move the web of media along the transport path; and a plurality of nip rollers aligned with the second section of the drive roller, wherein the web of media passes between the drive roller and the nip rollers, with the nip rollers contacting the second side of the web of media.

This invention has the advantage that the drive roller has a concave surface profile to provide a lateral stretching force on the web of receiver media, thereby reducing a susceptibility to media wrinkling, while simultaneously providing nip rollers in a central section of the drive roller having a constant outer diameter to provide a constant surface velocity, thereby reducing undesirable stresses within the receiver media.

It has the additional advantage that locating the nip rollers in the central section of the drive roller is useful to accommodate a variety of media widths, and also enables the receiver media to freely expand outward from the center as it absorbs moisture due to ink deposition. Recesses formed in the exterior surface of the drive roller are adapted to further reduce the susceptibility to wrinkle formation by enabling the expanded receiver media to sag into the recesses.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
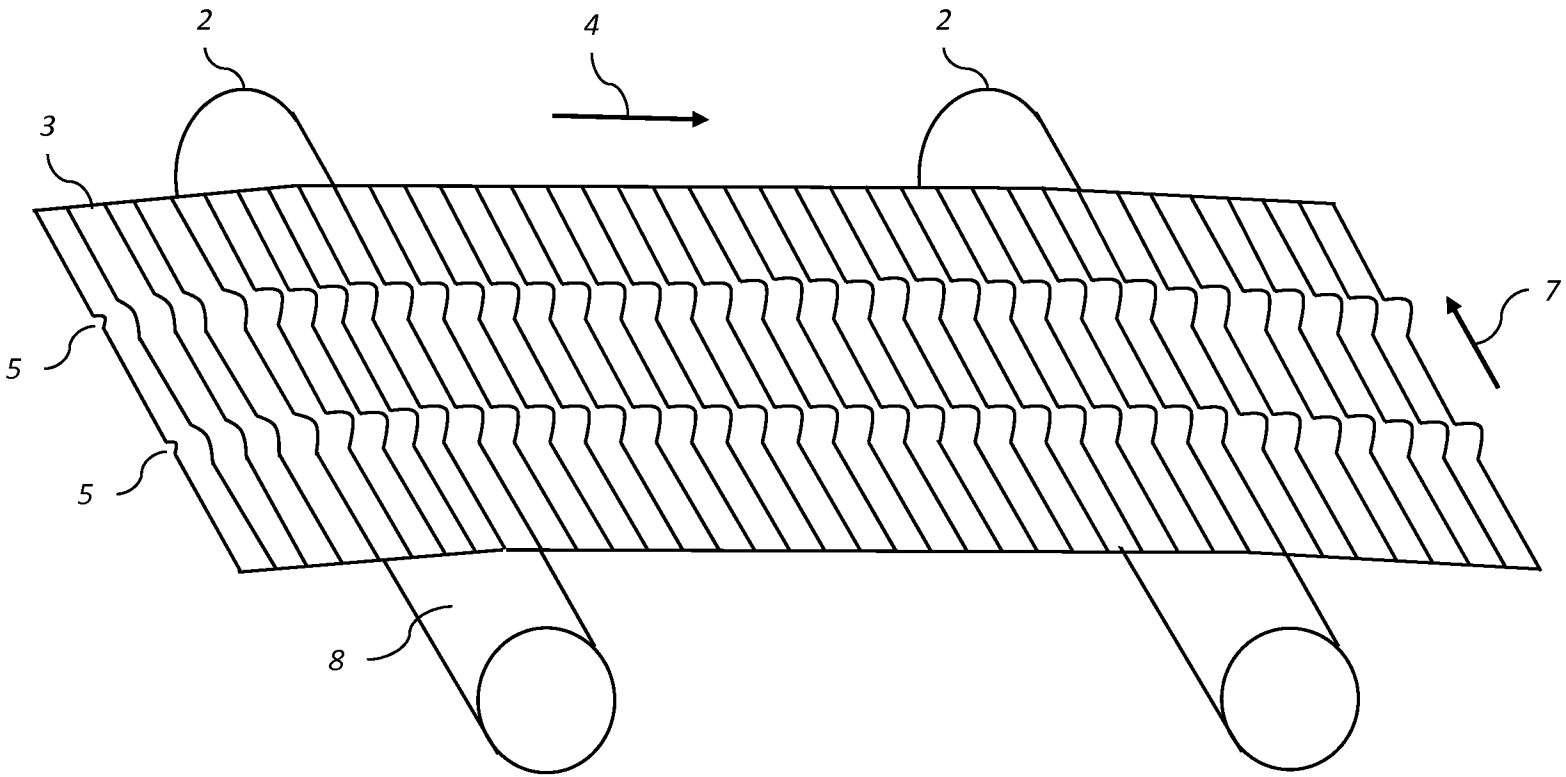
FIG. 1 (Prior Art)
FIG. 1 illustrates the formation of flutes in a continuous web of receiver media due to cross-track expansion of the receiver media.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and may not be to scale for the sake of clarity. One of ordinary skill in the art will be able to readily determine the specific size and interconnections of the elements of the example embodiments of the present invention.

As described herein, the exemplary embodiments of the present invention provide receiver media guiding components useful for guiding the receiver media in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard and corrugated cardboard can comprise the receiver media. Additionally, although the term "inkjet" is often used to describe printing processes, it can also be used to describe other processes that involve the non-contact application of ink, or other liquids, to a receiver media in a consistent, metered fashion, particularly if the desired result is a thin layer or coating. Typically, ink jetting mechanisms can be categorized as either drop-on-demand inkjet printing or continuous inkjet printing.

Drop-on-demand inkjet printing provides ink drops that impact upon a recording surface using a pressurization actuator, for example, a thermal, piezoelectric or electrostatic actuator. One commonly practiced drop-on-demand inkjet type uses thermal energy to eject ink drops from a nozzle. A heater, located at or near the nozzle, heats the ink sufficiently to form a vapor bubble that creates enough internal pressure to eject an ink drop. This form of inkjet is commonly termed "thermal inkjet." A second commonly practiced drop-on-demand inkjet type uses piezoelectric actuators to change the volume of an ink chamber to eject an ink drop.

The second technology commonly referred to as "continuous" inkjet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous inkjet printing type uses thermal stimulation of the liquid jet with a heater to form drops that eventually become printing drops and non-printing drops. Printing occurs by selectively deflecting either the printing drops or the non-printing drops and catching the non-printing drops using catchers. Various approaches for selectively deflecting drops have been developed including electrostatic deflection, air deflection, and thermal deflection.

There are typically two types of receiver media used with inkjet printing systems. The first type of receiver media is in the form of a continuous web, while the second type of receiver media is in the form of cut sheets. A continuous web of receiver media refers to a continuous strip of receiver media, generally originating from a source roll. The continuous web of receiver media is moved relative to the inkjet printing system components using a web transport system, which typically includes drive rollers, web guide rollers, and web tension sensors. Cut sheets refer to individual sheets of receiver media that are moved relative to the inkjet printing system components via rollers and drive wheels or via a conveyor belt system that is routed through the inkjet printing system.

The invention described herein is applicable to both drop-on-demand and continuous inkjet printing technologies that print on continuous webs of receiver media. As such, the term "printhead" as used herein is intended to be generic and not specific to either technology. Additionally, the invention described herein is also applicable to other types of printing systems, such as offset printing and electrophotographic printing, that print on continuous webs of receiver media.

The terms "upstream" and "downstream" are terms of art referring to relative positions along the transport path of the receiver media; points on the receiver media move along the transport path from upstream to downstream.

Figure 3:
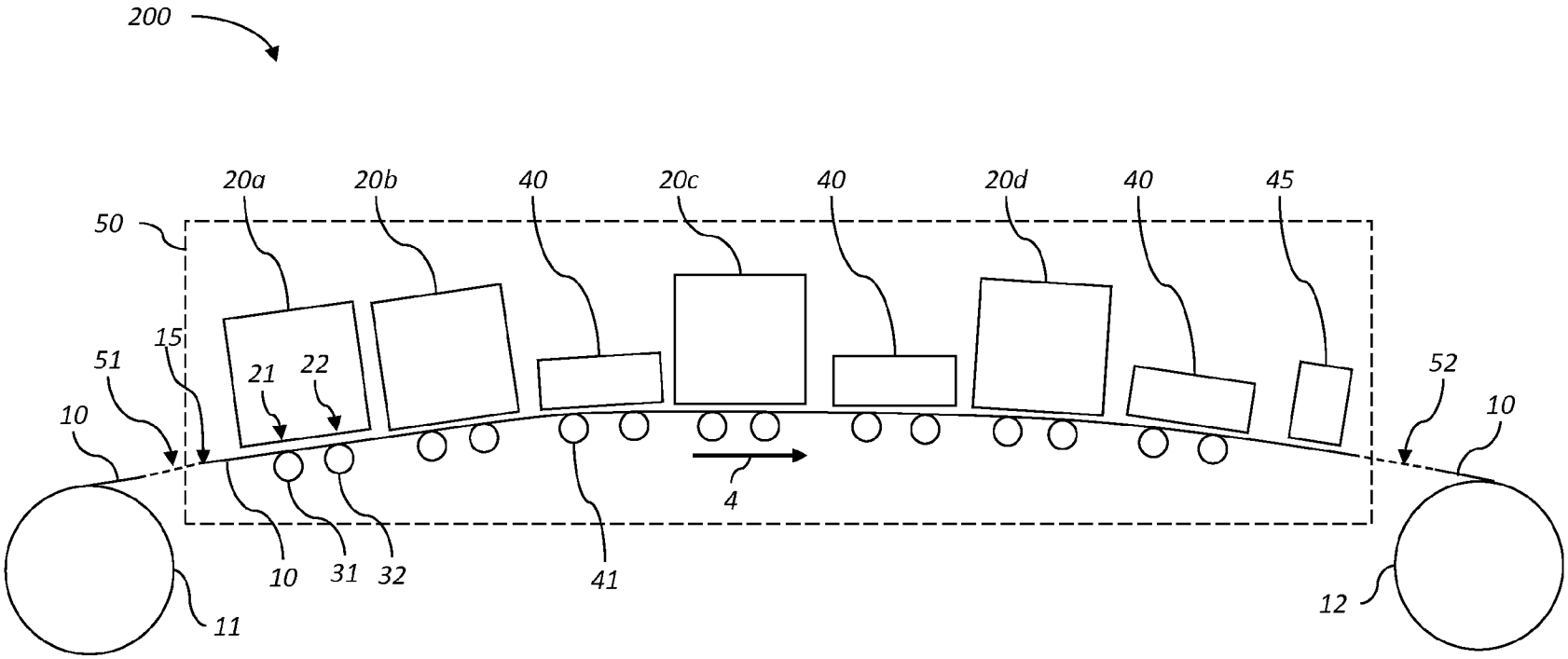
FIG. 3 is a simplified side view of an inkjet printing system.

Referring to FIG. 3, there is shown a simplified side view of a portion of a digital printing system 200 for printing on a first side 15 of a continuous web of receiver media 10. The printing system 200 includes a printing module 50 which includes printheads 20*a*, 20*b*, 20*c*, 20*d*, dryers 40, and a quality control sensor 45. In this exemplary system, the first printhead 20*a* jets cyan ink, the second printhead 20*b* jets magenta ink, the third printhead 20*c* jets yellow ink, and the fourth printhead 20*d* jets black ink.

Below each printhead 20*a*, 20*b*, 20*c*, 20*d* is a media guide assembly including print line rollers 31 and 32 that guide the continuous web of receiver media 10 past a first print line 21 and a second print line 22 as the receiver media 10 is advanced along a media path in the in-track direction 4. Below each dryer 40 is at least one dryer roller 41 for controlling the position of the web of receiver media 10 near the dryers 40.

Receiver media 10 originates from a source roll 11 of unprinted receiver media 10, and printed receiver media 10 is wound onto a take-up roll 12. Other details of the printing module 50 and the printing system 200 are not shown in FIG. 3 for simplicity. For example, to the left of printing module 50, a first zone 51 (illustrated as a dashed line region in receiver media 10) can include a slack loop, a web tensioning system, an edge guide and other elements that are not shown. To the right of printing module 50, a second zone 52 (illustrated as a dashed line region in receiver media 10) can include a turnover mechanism and a second printing module similar to printing module 50 for printing on a second side of the receiver media 10.

Figure 4:
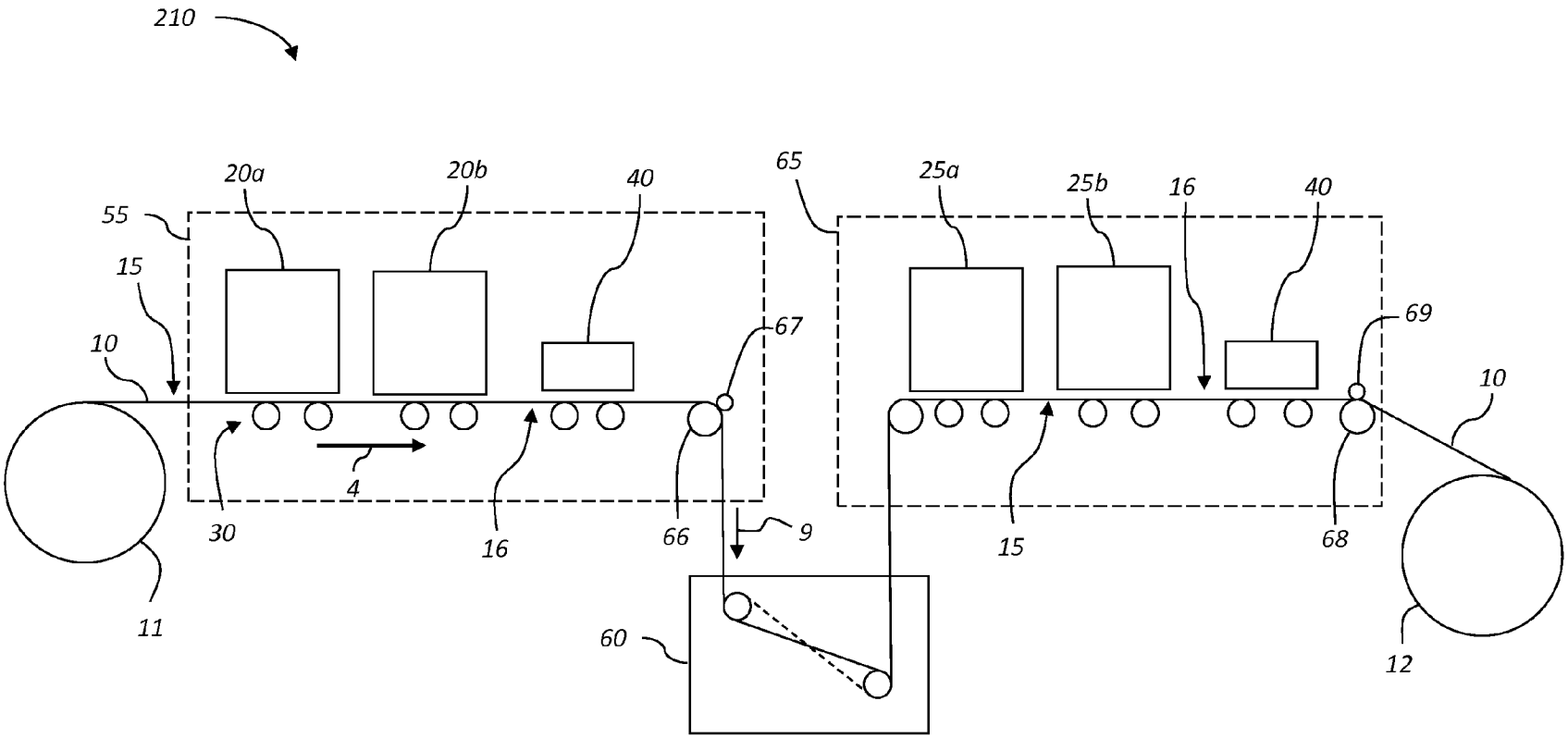
FIG. 4 is a simplified side view of an inkjet printing system for printing on both sides of a web of receiver media.

Referring to FIG. 4, there is shown a simplified side view of a portion of a printing system 210 for printing on both a first side 15 and a second side 16 of a continuous web of receiver media 10. Printing system 210 includes a first printing module 55, for printing on a first side 15 of the continuous web, having two printheads 20*a*, 20*b* and a dryer 40; a turnover mechanism 60; and a second printing module 65, for printing on the second side 16 of the continuous web of receiver media 10, having two printheads 25*a* and 25*b* and a dryer 40. A web-guiding system 30 guides the web of receiver media 10 from upstream to downstream along a transport path in the in-track direction 4 through the first printing module 55 and the second printing module 65. The web-guiding system 30 includes rollers aligned with the print lines of the printheads 20*a*, 20*b*, 25*a*, and 25*b*. These rollers maintain the receiver media 10 at a fixed spacing from the printing modules to ensure a consistent time of flight for the print drops emitted by the printheads. The web-guiding system 30 includes a drive roller 66 for applying tension to the web of receiver media 10 for advancing it along exit direction 9 of first printing module 55 toward the turnover mechanism 60. Nip roller(s) 67 hold the web of receiver media 10 in contact with the drive roller 66. The web-guiding system 30 also includes a drive roller 68 near the exit of second printing module 65 for applying tension to the web of receiver media 10 for advancing it toward take-up roll 12. Nip roller(s) 69 hold the web of receiver media 10 in contact with drive roller 68. Motors (not shown in FIG. 4) rotate the drive rollers 66, 68, thereby providing a force to move the web of receiver media 10 along the transport path. The movement of the receiver media 10 past the guiding rollers of the web guide system 30 helps to maintain the cross-track position of the continuous web of receiver media 10 provided there is sufficient traction between the receiver media 10 and the guiding rollers.

Figure 5:
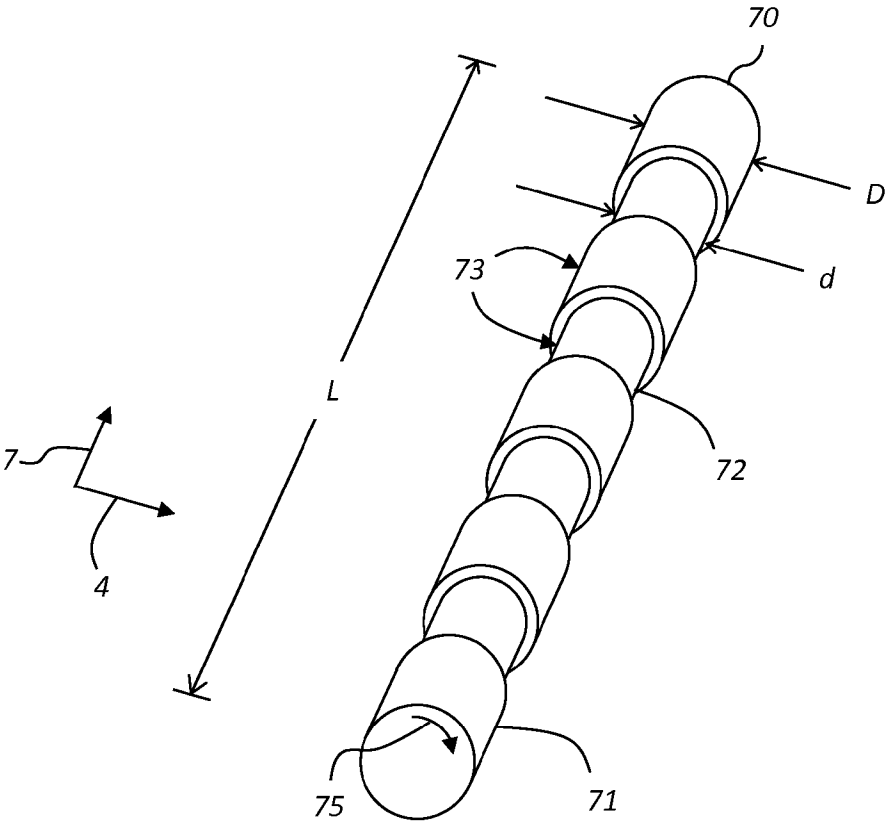
FIG. 5 (Prior Art)
FIG. 5 is a perspective diagram of a prior art web-guiding structure having ridges and recesses.

Aforementioned U.S. Pat. No. 8,303,106 discloses a roller for use as a web-guiding structure having a pattern of recesses and ridges positioned along its axis of rotation. FIG. 5 shows a perspective of an example of a web-guiding structure 70 similar to that described in U.S. Pat. No. 8,303,106 having ridges 71 and recesses 72 alternately disposed along its length. The web-guiding structure 70 extends along a length L that is parallel to cross-track direction 7 and provides a curved exterior surface 73 having a cylindrical shape. The diameter of the exterior surface 73 of web-guiding structure 70 varies along length L to form the pattern of ridges 71 and recesses 72. In particular, the diameter of exterior surface 73 at a ridge 71 is D, and the diameter of exterior surface 73 at a recess 72 is d, where $d<D$. In this example, each recess 72 is a groove in the web-guiding structure 70, where the grooves extend around at least a portion of the exterior surface 73 and are parallel to the in-track direction 4. The grooves that form the recesses 72 can be equally spaced or non-equally spaced.

Web-guiding structure 70 can be a roller that rotates in rotation direction 75, either being driven by a motor (not shown) or being passively rotated by the web of receiver media 10 moving in contact with the exterior surface 73 of the web-guiding structure 70, and particularly the exterior surface 73 of the ridges 71. The recesses 72 provide regions for the web of receiver media 10, which has undergone dimensional changes due to ink deposition by printheads 20*a*, 20*b*, 20*c*, 20*d* and by dryers 40 (FIG. 4), to fit into as web of receiver media 10 wraps around web-guiding structure 70. This reduces the likelihood of the receiver media 10 wrinkling as it wraps around web-guiding structure 70.

Figure 6:
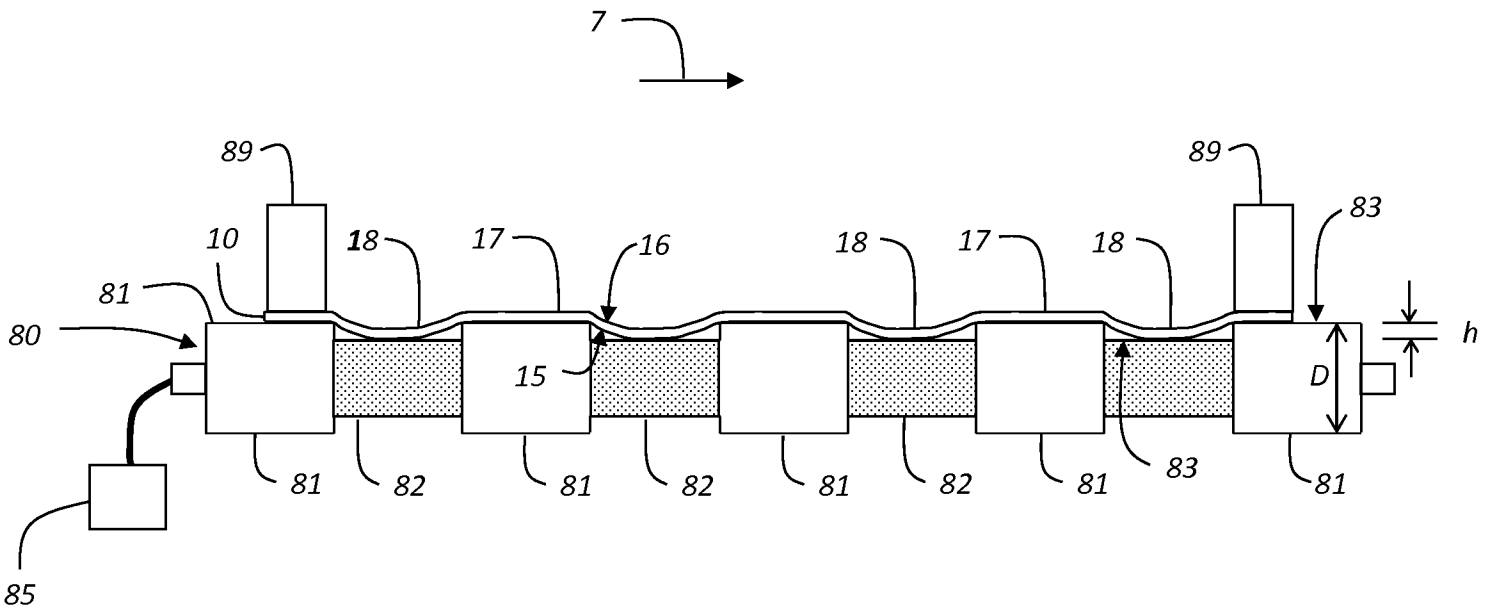
FIG. 6 (Prior Art)
FIG. 6 is a side view of a prior art drive roller where portions of the web of receiver media extend into recesses in the drive roller.

FIG. 6 shows a side view of a drive roller 80 having a pattern or ridges 81 and recesses 82 similar to that described in commonly-assigned, U.S. Patent Application Publication 2012/0223118 to Piatt et al., entitled "Web media moving apparatus," which is incorporated herein by reference. The drive roller 80 is driven to rotate by motor 85. Some receiver media portions 17 are in contact with the exterior surface 83 of the ridges 81, and other receiver media portions 18 extend into the recesses 82. The extent to which the receiver media portions 18 can be accommodated in the recesses 82 is limited by the first side 15 of the receiver media 10 contacting the bottoms (i.e., the exterior surfaces 83) of recesses 82, which is related to a depth h of recesses 82. In the drive roller 80 shown in FIG. 6, the ridges 81 are shown as with a constant outer diameter so that an envelope around the exterior surface 83 of the ridges 81 has a uniform diameter D. Nip rollers 89 are provided to hold web of receiver media 10 against ridges 81 at the outer ends of drive roller 80.

Figure 7:
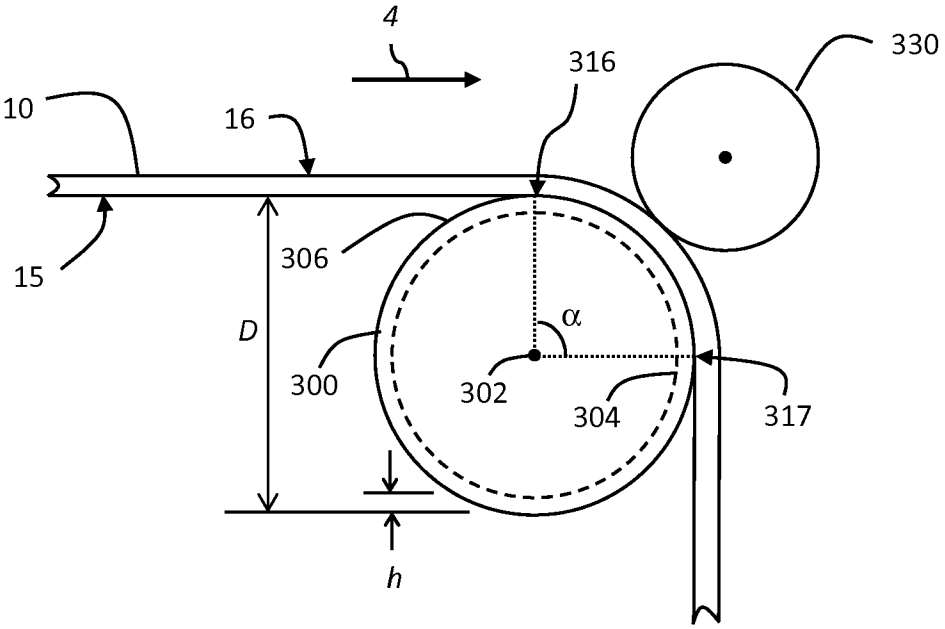
FIG. 7 is a cross-section of a drive roller configuration according to an exemplary embodiment.

FIG. 7 shows a cross-section of a drive roller 300 having an outer diameter D and an axis 302, where the web of receiver media 10 is shown wrapping around the drive roller 300 for a wrap angle α. The wrap of the web of receiver media 10 extends from an entry contact boundary 316 to an exit contact boundary 317. The wrap angle α corresponds to the amount of redirection in the direction of travel of the web of receiver media 10 by the drive roller 300. In the illustrated example, the wrap angle α is approximately equal to 90 degrees. (This is similar to the wrap angle shown in FIG. 4 for drive roller 66.) A nip roller 330 contacts the second side 16 of receiver media 10 in order to hold the first side of receiver media 10 against the exterior surface a ridge 306 of drive roller 300. Recesses 304 having a depth h are formed in the drive roller 300 and are indicated by a dashed circle.

Figure 8:
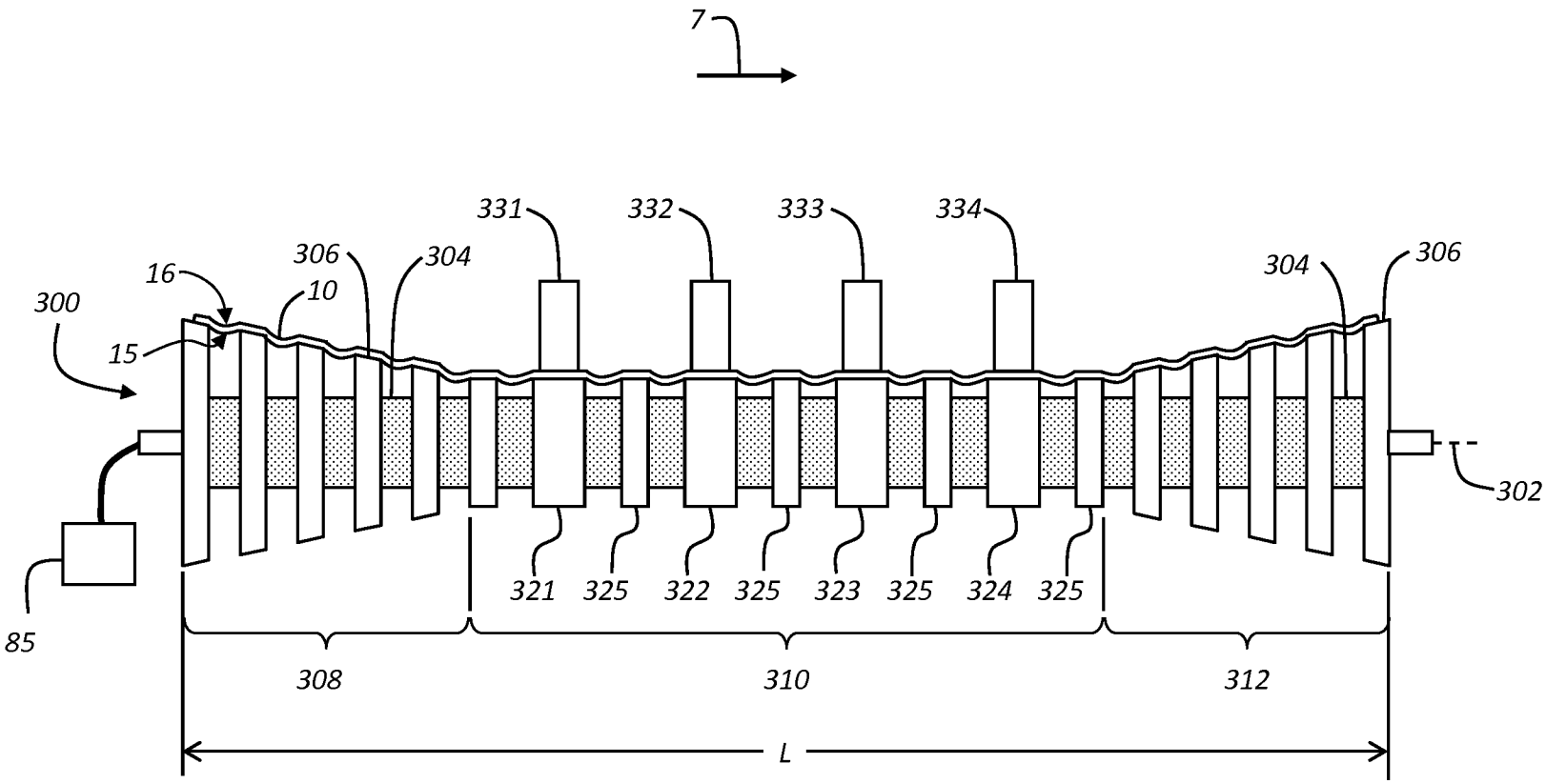
FIG. 8 is a side view of a drive roller configuration according to an exemplary embodiment.
Figure 9:
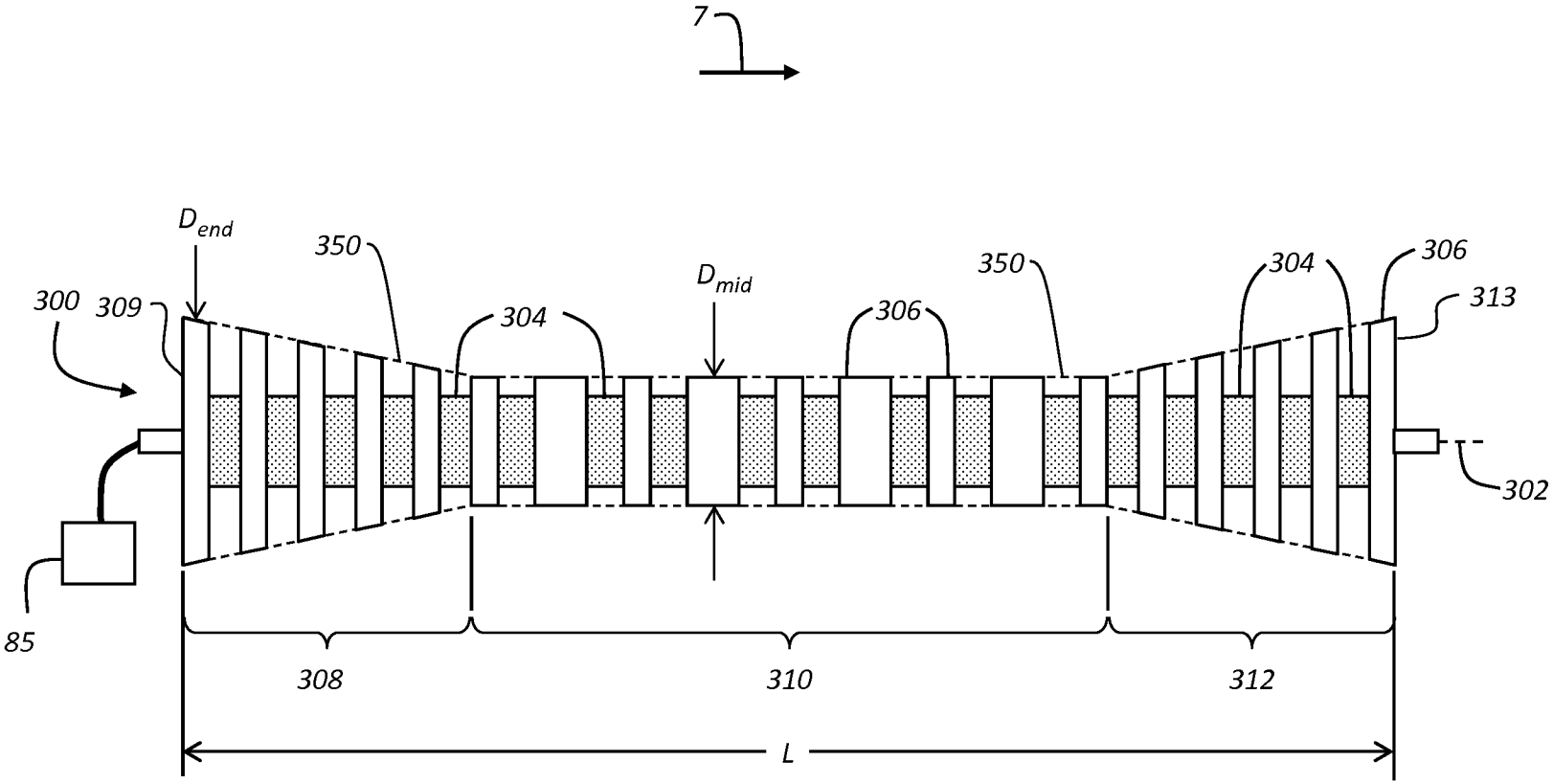
FIG. 9 shows the drive roller configuration of FIG. 8, but without the web of receiver media.

FIGS. 8 and 9 show side views of drive roller 300, according to an exemplary embodiment of the invention. The drive roller 300 has an axis 302 and a length L in the cross-track direction 7. The drive roller 300 has a pattern of alternating recesses 304 and ridges 306 formed into its exterior surface, where the outer diameter of the ridges 306 varies along the length of the drive roller. Motor 85 is used to rotate the drive roller 300 around the axis 302. In various embodiments, gears, clutches or any other type of coupling known in the art can be used to transfer rotational force from the motor 85 to the drive roller 300.

The drive roller 300 is divided into a first section 308, a second section 310 and a third section 312, where the ridges 306 in the centrally-located second section 310 of the drive roller 300 have a substantially constant diameter $D_{mid}$, and the ridges 306 in the outer first section 308 and third section 312 have diameters that are larger than $D_{mid}$. The diameter of the ridges 306 varies within the first section 308 and the third section 310 such that the outer diameter of the ridges 306 is larger proximate to outer end 309 and outer end 313, respectively, than it is proximate to the second section 310 of the drive roller 300. In the first section 308, the diameters of the ridges 306 increase monotonically from $D_{mid}$ to a maximum diameter of $D_{end}$ at outer end 309. Similarly, in the third section 312 the diameters of the ridges 306 increase monotonically from $D_{mid}$ to a maximum diameter of $D_{end}$ at outer end 313. In the illustrated embodiment, the diameters of the ridges 306 increase in an approximately linear fashion. In alternate embodiments (not shown), the diameters of the ridges 306 can increase according to other patterns such as a parabolic pattern.

As shown in FIG. 8, the web of receiver media 10 spans at least a portion of the drive roller 300 in the cross track direction 7, such that a first side 15 of the receiver media 10 contacts and is supported by ridges 306 of the drive roller 300 (i.e., on the exterior surface of drive roller 300). In the illustrated embodiment, portions of the web of receiver media 10 sag into the recesses 304 between adjacent ridges 306.

Within the context of the present disclosure, the "surface envelope" of the drive roller 300 is defined to be a surface formed by joining the peaks of each of the ridges 306, it can be seen in FIG. 9 that surface envelope 350 has a concave shape. The surface envelope 350 can also be referred to as the "outer diameter" of the drive roller 300. As noted in U.S. Pat. No. 8,303,106, such a concave surface profile can provide lateral forces on the web of receiver media 10 that tend to stretch the web of receiver media 10 in the cross track direction 7. This helps to compensate for cross track expansion of the web of receiver media 10 caused by absorption of water-based ink during printing, thereby helping to reduce susceptibility to media wrinkling. The appropriate shape of the surface profile will depend on the traction of the receiver media 10 around the drive roller 300. The amount of traction will depend on a variety of factors including the surface properties of the drive roller 300 and the receiver media 10, the tension of the receiver media 10, the pressure exerted by nip rollers, and the wrap angle α (FIG. 7). A concave surface envelope 350 (as in FIG. 9) is generally appropriate for high-traction configurations (e.g., for wrap angles α that are larger than about 10 degrees).

A plurality of nip rollers 331, 332, 333, 334 are shown in FIG. 8 which are aligned with the second section 310 of the drive roller 300 The nip rollers 331, 332, 333, 334 are arranged such that the web of receiver media 10 passes between the drive roller 300 and the nip rollers 331, 332, 333, 334, with the nip rollers 331, 332, 333, 334 contacting the second side 16 of the web of receiver media 10. The nip rollers 331, 332, 333, 334 are aligned with corresponding ridges 306 in the in the second section 310 of drive roller 300. In the illustrated embodiment, the nip rollers 331, 332, 333, 334 are aligned with respective nip support ridges 321, 322, 323, 324.

In the example shown in FIG. 8, in order to provide a sufficient nip width against the nip rollers 331, 332, 333, 334, the corresponding nip support ridges 321, 322, 323, 324 are wider than at least some of the other ridges 306 of drive roller 300. In particular, in this example, intervening ridges 325 located between the nip support ridges 321, 322, 323, 324 are narrower than the nip support ridges 321, 322, 323 and 324. In addition, the ridges 306 in the first section 308 and the third section 312 are also narrower than the nip support ridges 321, 322, 323, 324. In order to ensure that the nip rollers 331, 332, 333, 334 do not extend past the corresponding nip support ridges 321, 322, 323, 324, and thereby overhang the recesses 304, the width of the nip rollers 331, 332, 333, 334 can be made somewhat narrower than the corresponding nip support ridges 321, 322, 323, 324, as shown in FIG. 8. In a preferred embodiment, the nip rollers 331, 332, 333, 334 are at least 5% narrower than the corresponding nip support ridges 321, 322, 323, 324.

In accordance with the illustrated exemplary embodiment, all four nip rollers 331, 332, 333, 334 are aligned with the second section 310 of drive roller 300 and no nip rollers are aligned with the first section 308 or the third section 310 of the drive roller 300. This is advantageous in several respects. Since the diameter of the ridges 306 in the first section 308 and third section 312 varies, if a conventional cylindrical nip roller were aligned with a ridge 306 in the first section 308 or the third section 312, it would only make contact at its outermost edge. Furthermore, even if a conical shaped nip roller were used to make contact along a sloped ridge 306, the nip roller would have different surface velocities along its contact surface, which could cause undesirable stresses within the web of receiver media 10.

Figure 2:
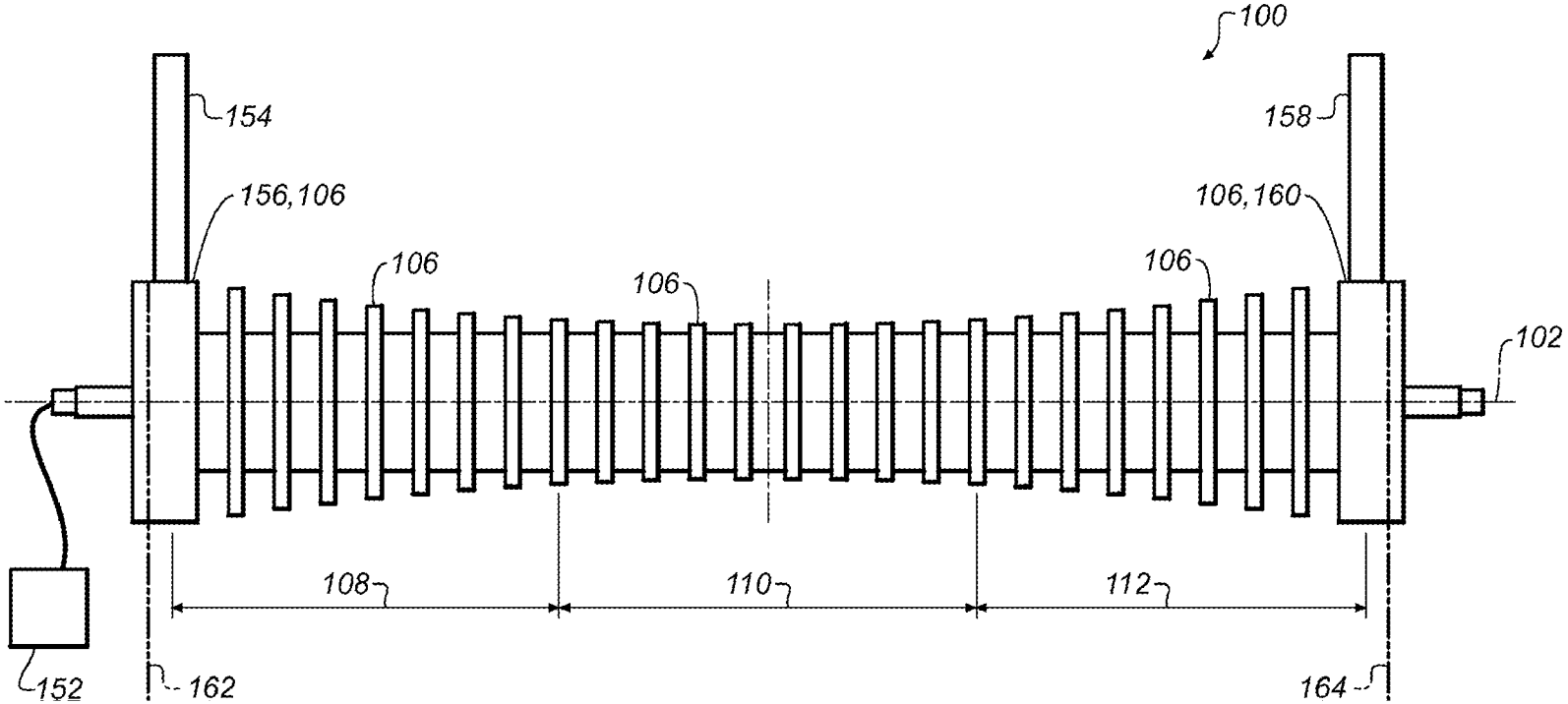
FIG. 2 (Prior Art)
FIG. 2 is a prior art drive roller configuration having alternating ridges and recesses and nip rollers located at the ends of the drive roller.
Figure 10:
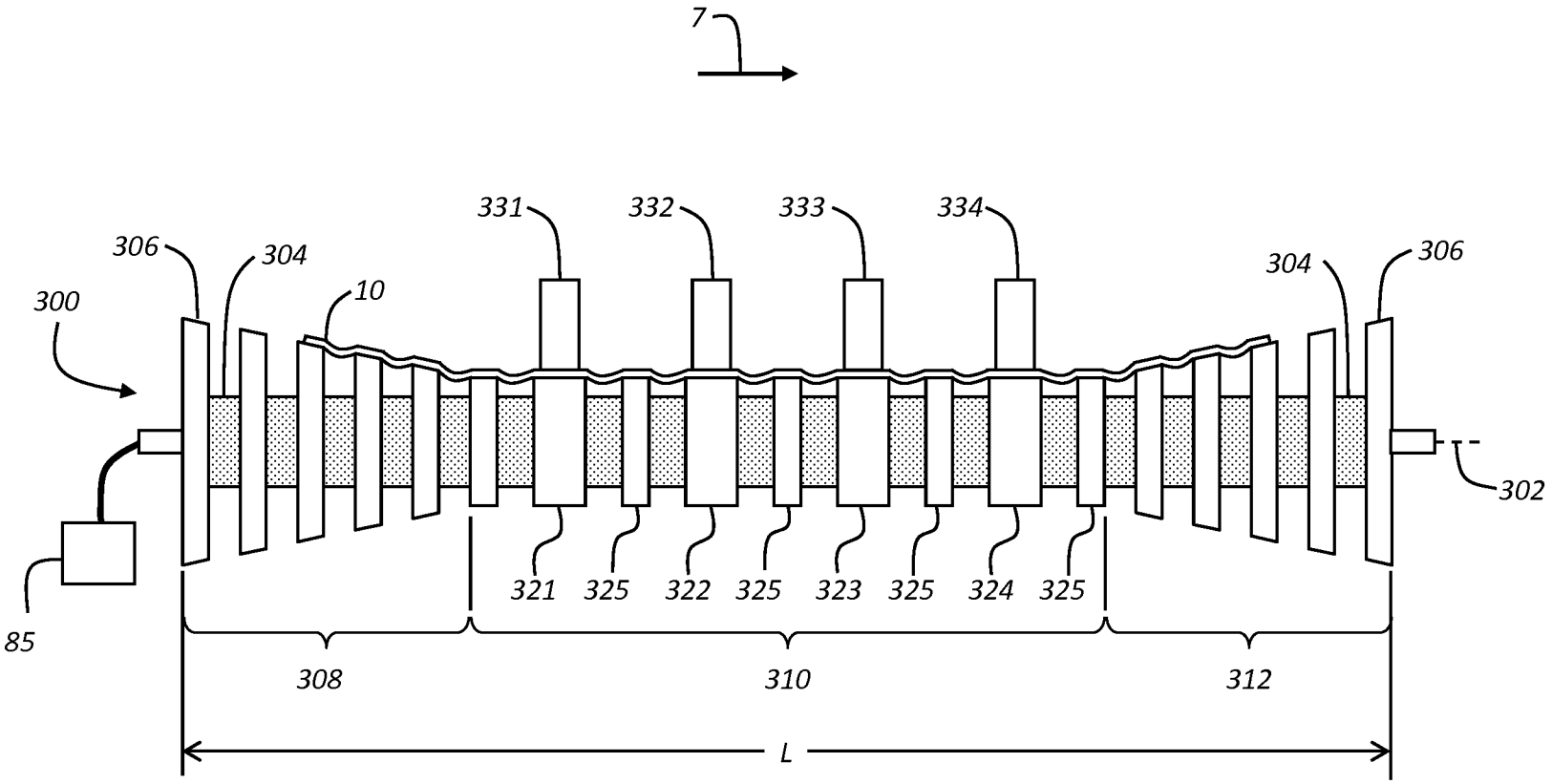
FIG. 10 shows the drive roller configuration of FIG. 8, but with a narrower web of receiver media.

FIG. 10 illustrates another advantageous feature of the nip rollers being aligned with the second section 310 of drive roller 300. In FIG. 10, the drive roller 300 and the nip rollers 331, 332, 333 and 334 are the same as in FIGS. 8 and 9, but the web of receiver media 10 is narrower than the length L of the drive roller 300. Nip rollers 331, 332, 333, 334 continue to be in contact with web of receiver media 10. In contrast, such a narrow width of receiver media 10 would not be held by the nip rollers 154 and 158 in the prior art configuration shown in FIG. 2.

Although the embodiments shown in FIGS. 8-10 each have four nip rollers 331, 332, 333, 334 aligned with second section 310 of drive roller 300, other embodiments (not shown) can have more than four or fewer than four nip rollers.

Figure 11:
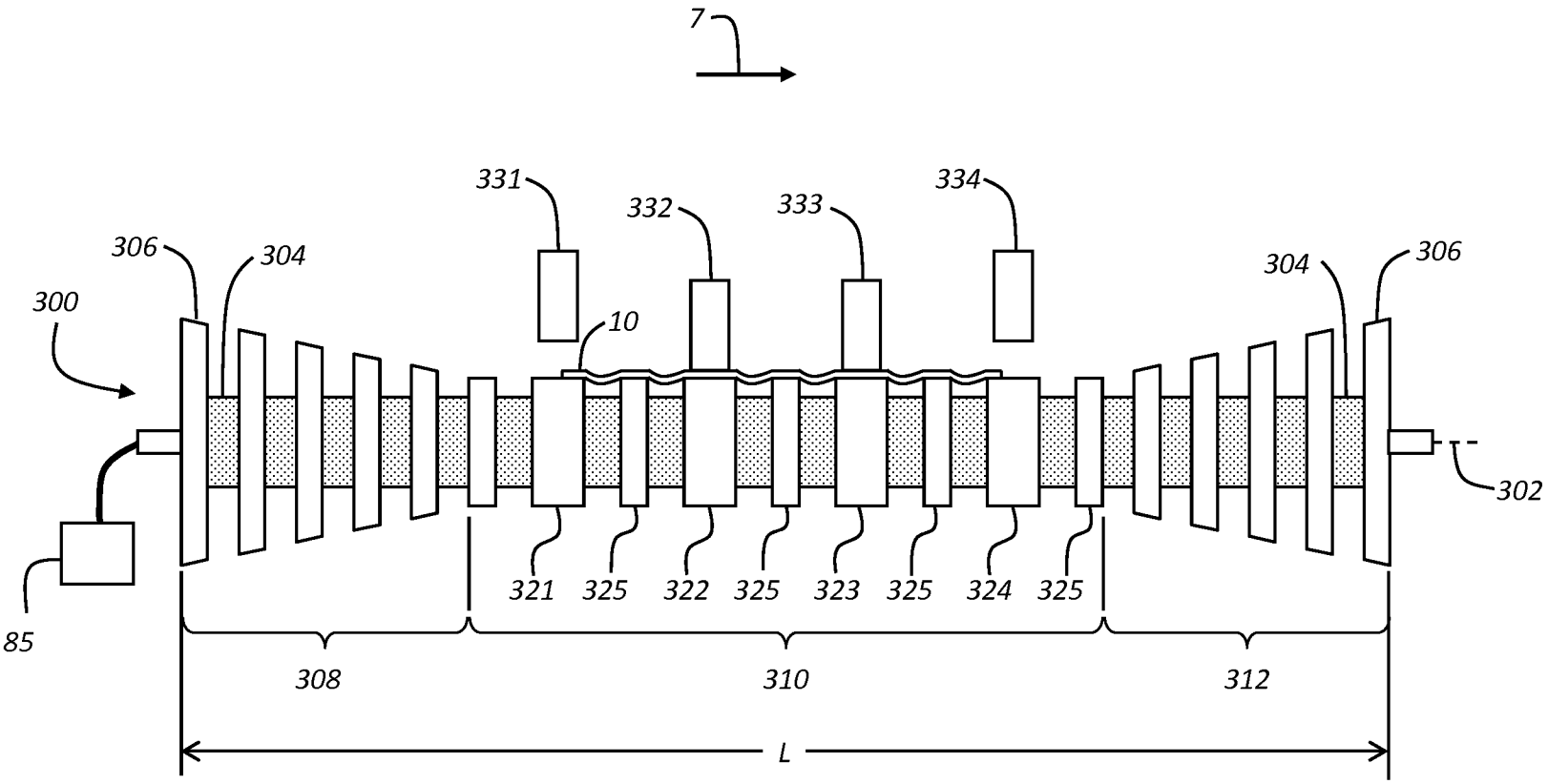
FIG. 11 shows a drive roller configuration similar to that of FIG. 8, but with repositionable nip rollers.

In some embodiments, at least one of the nip rollers 331, 332, 333, 334 is repositionable so that it can be moved away from drive roller 300. For example, FIG. 11 shows an exemplary embodiment where the outer nip rollers 331, 334 have been repositioned away from drive roller 300. The repositioning can be accomplished using any method know in the art. For example, the repositioning can be done by employing a pivoting action, as in a typewriter bail, or by employing a radially-outward lifting action. If the web of receiver media 10 is sufficiently narrow as in FIG. 11, the outer nip rollers 331, 334 might not be able to make reliable contact with web of receiver media 10. If the nip rollers 331, 334 were in contact with the receiver media 10 too near the edges of the web of receiver media 10, they could move off the edges of the receiver media 10 and cause web breaks, so it can be advantageous to reposition them to be out of contact.

Figure 12:
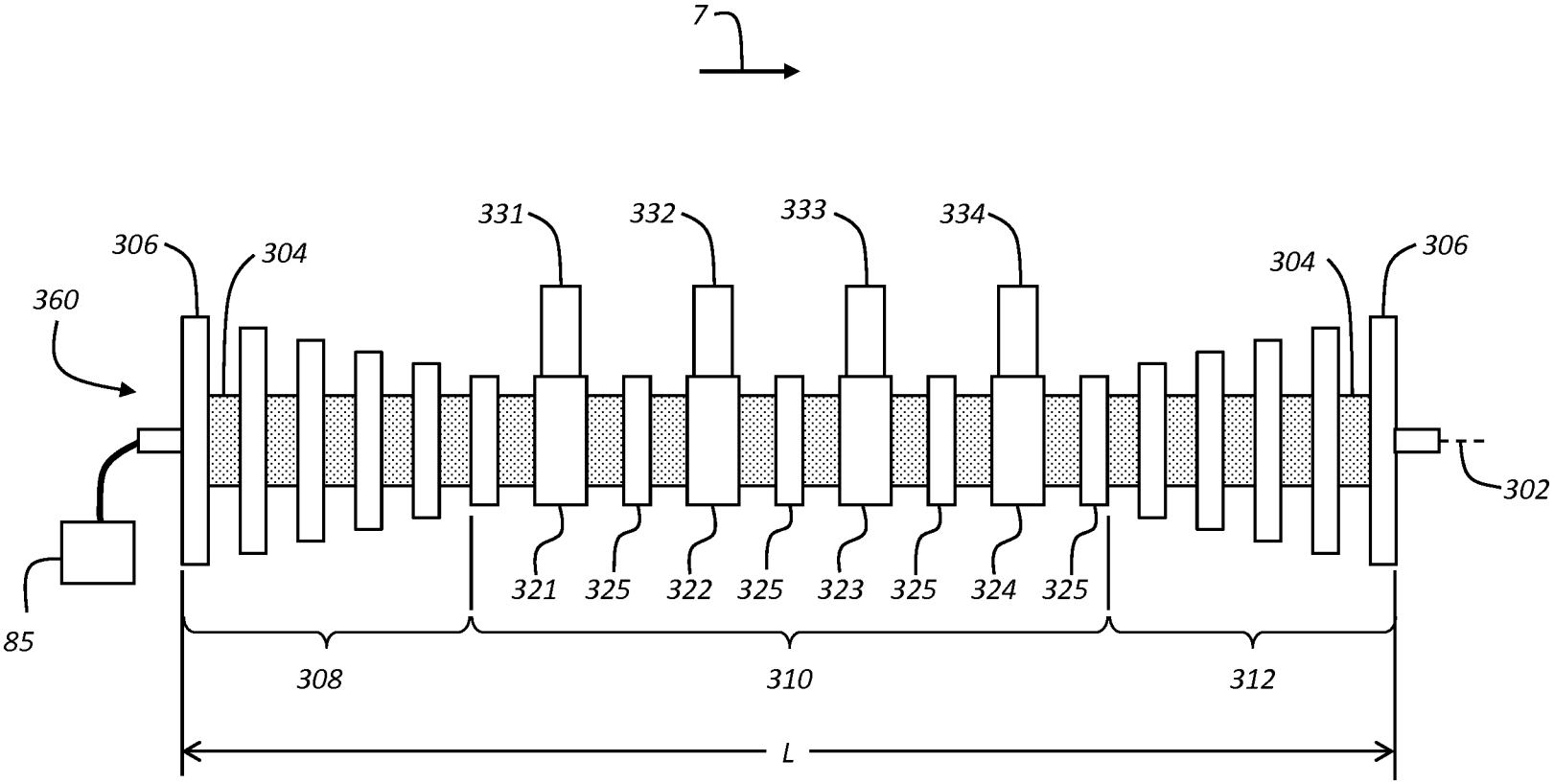
FIG. 12 is a side view of a drive roller configuration according to an alternate embodiment.

FIG. 12 shows another embodiment of a drive roller 360 and nip rollers 331, 332, 333 and 334. Like the drive roller 300 of FIG. 8, the outer diameter of the drive roller 360 varies monotonically within the first section 308 and the third section 312 of drive roller 360. However, in this embodiment the diameter of each ridge 306 is constant such that the ridges have a cylindrical shape. In contrast the diameter of the ridges 306 in the first section 308 and the third section 312 of the drive roller 300 in FIG. 9 varies such that the ridges have a conical shape.

Figure 13:
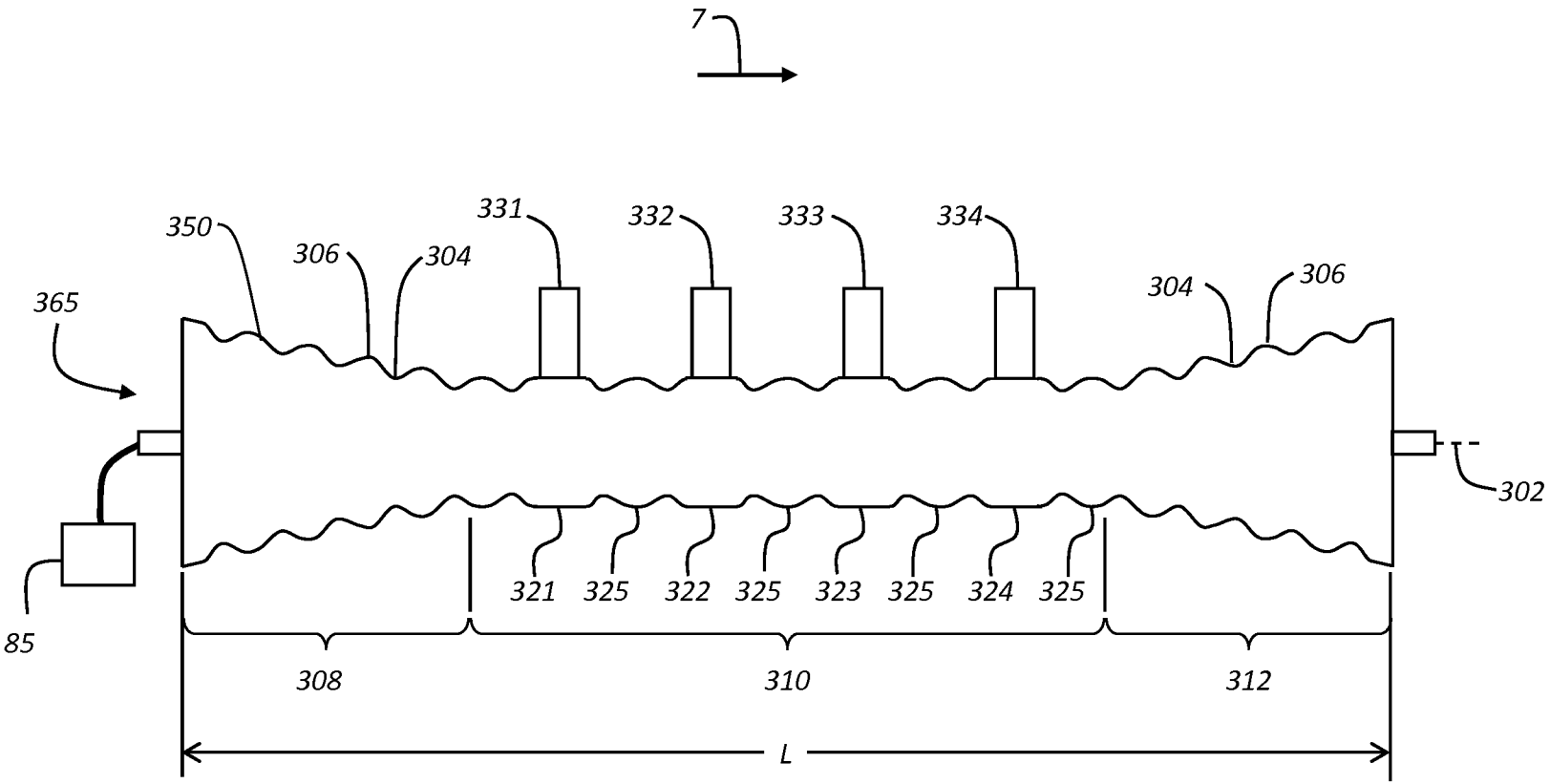
FIG. 13 shows a drive roller configuration similar to that of FIG. 8 but with ridges having rounded edges.

FIG. 13 illustrates another embodiment of a drive roller 365. The drive roller 370 is similar to the drive roller 300 of FIG. 8 except that the recesses 304 and ridges 306 are formed with rounded edges. The nip support ridges 321, 322, 323, 324 have a flat top corresponding to the portions of the exterior surface of the drive roller 365 that are aligned with the nip rollers 331, 332, 333, 334. In this example, the intervening ridges 325, as well as the ridges 306 in the first section 308 and the third section 312 have a continuously varying slope. In some embodiments, the recesses 304 and the ridges 306 (particularly the ridges 306 that are not nip support ridges 321, 322, 323, 324) are provided according to the design guidelines described in commonly-assigned, co-pending U.S. patent application Ser. No. 14/222,699 to Muir et al., entitled "Web-guiding structure with continuous smooth recesses," which is incorporated herein by reference. In this case, the surface profile in the cross-track direction 7 preferably has a maximum slope magnitude of no more than 0.3 and a minimum radius of curvature magnitude of no less than 5 mm.

Figure 14:
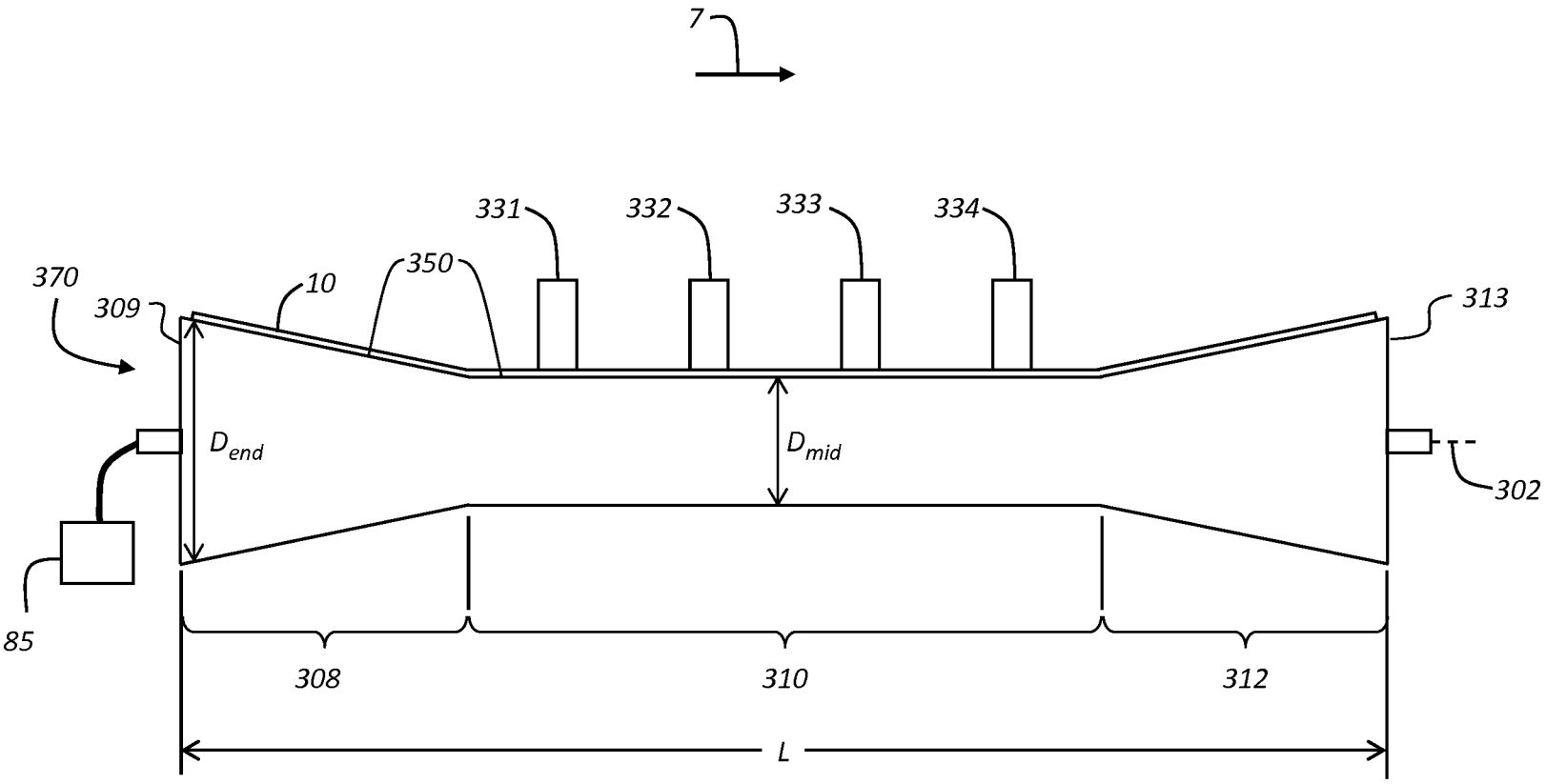
FIG. 14 is a side view of a drive roller configuration according to an alternate embodiment where no recesses are provided in the drive roller.

FIG. 14 illustrates another embodiment of a drive roller 370. The drive roller 370 is similar to the drive roller 300 of FIG. 8 except that no recesses 304 are formed into the exterior surface of the drive roller 370. In this case, the exterior surface of the drive roller 370 defines the surface envelope 350. The drive roller 370 is divided into a first section 308, a second section 310 and a third section 312, where the exterior surface of the drive roller 370 in the centrally-located second section 310 has a substantially constant diameter $D_{mid}$, and the exterior surface of the drive roller 370 in the outer first section 308 and third section 312 have diameters that are larger than $D_{mid}$. The diameter of the exterior surface of the drive roller 370 varies within the first section 308 and the third section 310 such that the diameter is larger near outer end 309 and outer end 313, respectively, than it is near the second section 310 of the drive roller 300. In the first section 308, the diameter of the exterior surface of the drive roller 370 increases monotonically from $D_{mid}$ to a maximum diameter of $D_{end}$ at outer end 309. Similarly, in the third section 312 the diameter of the exterior surface of the drive roller 370 increases monotonically from $D_{mid}$ to a maximum diameter of $D_{end}$ at outer end 313.

The invention has been described in detail with particular reference to certain preferred embodiments thereof, but it will be understood that variations and modifications can be effected within the spirit and scope of the invention.

PARTS LIST

2 roller
3 receiver media
4 in-track direction
5 flute
7 cross-track direction
8 contact surface
9 exit direction
10 receiver media
11 source roll
12 take-up roll
15 first side
16 second side
17 receiver media portions
18 receiver media portions
20*a* printhead
20*b* printhead
20*c* printhead
20*d* printhead
21 print line
22 print line
25*a* printhead
25*b* printhead
30 web-guiding system
31 print line roller
32 print line roller
40 dryer
41 dryer roller
45 quality control sensor
50 printing module
51 first zone
52 second zone
55 printing module
60 turnover mechanism
65 printing module
66 drive roller

67 nip roller
68 drive roller
69 nip roller
70 web-guiding structure
71 ridge
72 recess
73 exterior surface
75 rotation direction
80 drive roller
81 ridge
82 recess
83 exterior surface
85 motor
89 nip roller
100 roller
102 axis of rotation
106 ridge
108 first section
110 second section
112 third section
152 motor
154 nip roller
156 first ridge
158 nip roller
160 second ridge
162 first edge
164 second edge
200 printing system
210 printing system
300 drive roller
302 axis
304 recess
306 ridge
308 first section
309 outer end
310 second section
312 third section
313 outer end
316 entry contact boundary
317 exit contact boundary
321 nip support ridge
322 nip support ridge
323 nip support ridge
324 nip support ridge
325 intervening ridge
330 nip roller
331 nip roller
332 nip roller
333 nip roller
334 nip roller
350 surface envelope
360 drive roller
365 drive roller
370 drive roller
d diameter
D diameter
$D_{end}$ diameter
$D_{mid}$ diameter
h depth
L length
α wrap angle

The invention claimed is:

1. A web-guiding system for guiding a web of media having a width spanning a cross-track direction travelling from upstream to downstream along a transport path in an in-track direction, the web of media having a first side and an opposing second side, comprising:

a drive roller including an exterior surface, wherein the first side of the web of media contacts at least a portion of the exterior surface of the drive roller, the drive roller having a length and including a first section, a second section and a third section along the length of the roller, the second section being located between the first section and the third section, wherein a diameter of a surface envelope around the exterior surface of the drive roller is substantially constant within the second section and wherein the diameter of the surface envelope in the first section and the third section is larger than the diameter of the surface envelope in the second section;

a motor that rotates the drive roller, thereby providing a force to move the web of media along the transport path; and a plurality of nip rollers aligned with the second section of the drive roller, wherein the web of media passes between the drive roller and the nip rollers, with the nip rollers contacting the second side of the web of media.

2. The web-guiding system of claim 1 wherein the drive roller has a pattern of alternating ridges and recesses formed into the exterior surface along the length of the drive roller, and wherein the nip rollers are aligned with corresponding ridges in the second section of the drive roller.

3. The web-guiding system of claim 2 wherein the ridges corresponding to the nip rollers are wider than at least some of the other ridges.

4. The web-guiding system of claim 3 wherein intervening ridges between the ridges corresponding to the nip rollers are narrower than the ridges corresponding to the nip rollers.

5. The web-guiding system of claim 3 wherein the ridges in the first section and the third section are narrower than the ridges corresponding to the nip rollers.

6. The web-guiding system of claim 2 wherein a width of the nip rollers is narrower than a width of the corresponding ridges.

7. The web-guiding system of claim 2 wherein the ridges have rounded edges.

8. The web-guiding system of claim 7 wherein the exterior surface of the drive roller has a continuous and smooth surface profile in the cross-track direction, the surface profile having a maximum slope magnitude of no more than 0.3 and a minimum radius of curvature magnitude of no less than 5 mm.

9. The web-guiding system of claim 1 wherein there are no nip rollers aligned with the first section and the third section of the drive roller.

10. The web-guiding system of claim 1 wherein the diameter of the surface envelope varies within the first section and the third section of the drive roller.

11. The web-guiding system of claim 10 wherein the diameter of the surface envelope is larger proximate to outer ends of the drive roller than it is proximate to the second section of the drive roller.

12. The web-guiding system of claim 10 wherein the diameter of the surface envelope varies monotonically within the first section and the third section of the drive roller.

13. The web-guiding system of claim 10 wherein the diameter of the surface envelope varies within the first section and the third section of the drive roller to provide a concave surface envelope.

14. The web-guiding system of claim 1 wherein at least one of the nip rollers is repositionable so that it can be moved away from the drive roller.

* * * * *